US005549026A

United States Patent [19]

Gay, Jr.

[11] Patent Number: 5,549,026

[45] Date of Patent: Aug. 27, 1996

[54] STRINGED MUSICAL INSTRUMENT

[76] Inventor: Paul M. Gay, Jr., P.O. Box 404, Cordova, Ak. 99574

[21] Appl. No.: 399,383

[22] Filed: Mar. 6, 1995

Related U.S. Application Data

[63] Continuation-in-part of Ser. No. 187,152, Jan. 27, 1994, abandoned.

[51] Int. Cl.[6] ..... G10D 3/00; G10D 1/08

[52] U.S. Cl. ..... 84/292; 84/267

[58] Field of Search ..... 84/292, 291, 267, 84/268, 293

[56] References Cited

U.S. PATENT DOCUMENTS

| | | | |
|---|---|---|---|
| 1,210,368 | 12/1916 | Wachwitz | 84/292 |
| 3,072,007 | 1/1963 | Burke | 84/267 |
| 3,771,408 | 11/1973 | Wright | 84/291 |
| 4,126,073 | 11/1978 | Takabayashi | 84/293 |
| 4,188,850 | 2/1980 | Kaman, II | 84/291 |
| 4,915,004 | 4/1990 | Clough | 84/291 |

*Primary Examiner*—Cassandra C. Spyrou
*Attorney, Agent, or Firm*—Cahill, Sutton & Thomas P.L.C.

[57] ABSTRACT

A stringed, electric musical instrument, such as a guitar comprises an electroformed, seamless metallic body to which is attached the base portion of a neck assembly. In one embodiment of the invention the body is hollow and the base portion of the neck assembly is inserted into the body and fastened in contact with the inner surface of the top face of the body. In that embodiment, the bridge of the instrument is also fastened to the base portion of the neck assembly.

13 Claims, 2 Drawing Sheets

STRINGED MUSICAL INSTRUMENT

This application is a continuation-in-part of application Ser. No. 08/187,152, filed Jan. 27, 1994 now abandoned.

TECHNICAL FIELD

This invention is concerned with improving the tonal properties of stringed musical instruments, particularly electric guitars.

BACKGROUND ART

There are a variety of stringed musical instruments employing electrical pickups for sensing string vibrations to be amplified and played through loud speakers. The early electric guitars produced in the 1930's generally were conventional acoustic guitars with pickups mounted on the top of the large open cavity body. Today, this instrument is referred to as a "hollowbody" style guitar.

Although the conventional wood hollowbody electric guitar is capable of producing comparatively mellow tones, akin to an acoustic guitar, at least a couple of disadvantages have been ascribed to this type guitar. The large size, open cavity body resonates easily at moderate high volumes and relatively low frequencies and is therefore susceptible to feedback and may require electronic filtering. Also, the body of this type guitar is fabricated by gluing together numerous pieces of thin wood. This is a fragile, easily damaged, structure. Tonal properties of the instrument can be adversely affected by any loose glue joints or cracked panels.

Some instrument makers have proposed that the body of the instrument be fabricated from sheet metal to alter the tonal characteristics and provide a more durable structure. H. Wachwitz in his U.S. Pat. No. 1,210,368 granted Dec. 26, 1916, for "RESONANCE BODY FOR MUSICAL INSTRUMENTS" proposed that the body of the violin be fabricated from sheet metal. He proposed to use sheet aluminum coated on both sides with another metal such as gold, silver, cobalt, nickel or copper. His coating was to be applied prior to fabrication of the violin body, either in a mechanical way or according to an electrolytic process.

U.S. Pat. No. 3,771,408, granted Nov. 13, 1973, to R. O. Wright for "GUITAR BODY" discloses a guitar body fabricated of shaped strips of metal which are welded together. Wright proposed extensive internal bracing for the body to provide for the attachment of strings and electronic components. The Wright guitar is representative of that class, or type, of electric guitar which is generally referred to as the "semisolid body" guitar. Such guitars are difficult to fabricate, expensive to produce, and offer the opportunity for loose joints to occur.

Another example of the semisolid body guitar is disclosed in U.S. Pat. No. 3,072,007, granted Jan. 8, 1963, to G. F. Burke for "GUITAR CONSTRUCTION". Burke proposed to provide a cast metal neck having a body portion extending down the middle of the body and through the entire length of the body. The body was completed by wood side body portions bolted to the sides of the body portion of the neck and covered by top and bottom wood plates.

The many joints between the Burke guitar neck and body can come loose in use and ruin the tonal qualities of the instrument. Such results are almost assured because of the different coefficients of expansion of the metal neck and the wood body portions. In addition, the metal neck is heavy and can be uncomfortable to hold in cold weather.

Another example of a semisolid body guitar is disclosed in U.S. Pat. No. 4,915,004, granted Apr. 10, 1990, to E. Clough for "BODY FOR AN ELECTRONIC STRINGED INSTRUMENT". The body of this guitar has an inner metal chassis provided with a removable and replaceable outer body shell. The body shell is molded in plastic as separate top and bottom pieces which are held together with screws. This construction is also susceptible to the body parts becoming loose and affecting the tonal qualities of the instrument.

The third style of body commonly used for electric guitars is the "solidbody". This style has been popularized in large measure by the Gibson Company with its Les Paul line of guitars. The solidbody is just that; it is made of a solid piece or pieces of wood, plastic, or metal. A version of the solidbody with the neck extending into and becoming a part of the body is disclosed in U.S. Pat. No. 4,126,073, granted Nov. 21, 1978, to Y. Takabayashi for "ELECTRIC GUITAR"

Another version of the solidbody guitar is disclosed in U.S. Pat. No. 4,188,850, granted Feb. 19, 1980 to C. W. Kaman, II for "FOAMED PLASTIC GUITAR CONSTRUCTION". This guitar is comprised of a separate body and neck made of a metallic frame combined with a mass of structural foamed plastic.

The tonal qualities of the solidbody tend to be "bright" as opposed to the mellow tones of the acoustic guitar. Solidbodies are quite durable, although those fabricated in more than one piece may be susceptible to splitting and loosening at the joints. And, solidbodies afford greater sustain characteristics than the other body styles and are preferred by some musicians for this reason.

The principal drawback to the solidbody guitar is weight. It is simply too heavy for some guitarists.

There continues to be a need for a lightweight, durable, aesthetically pleasing instrument offering a mix of tonal characteristics and sustain of the three body style guitars described above.

DISCLOSURE OF THE INVENTION

The improved results are achieved in large measure by this invention by providing a body for the instrument which is metallic, thin-walled and seamless. Combined with this body is a neck assembly having a base portion which is secured to the top wall of the body. In one embodiment of the invention the base portion of the neck extends into the body at least to the location of the bridge of the guitar and that bridge is preferably secured to the top of the body by fasteners extending into that portion of the neck. In this embodiment the pickup of the guitar is preferably positioned in a recess in the base portion of the neck and extends upwardly through an opening in the top of the body beneath the strings of the instrument.

The body of the instrument is preferably electroformed over a mold shaped to the configuration desired for the body. In the embodiment of the invention referred to above, the mold is destroyed and removed from the interior of the body. In another embodiment the mold remains in the body of the instrument.

BRIEF DESCRIPTION OF THE DRAWINGS

The invention is described in greater detail hereinafter by reference to the accompanying drawings, wherein.

BEST MODES FOR CARRYING OUT THE INVENTION

Figure 1:
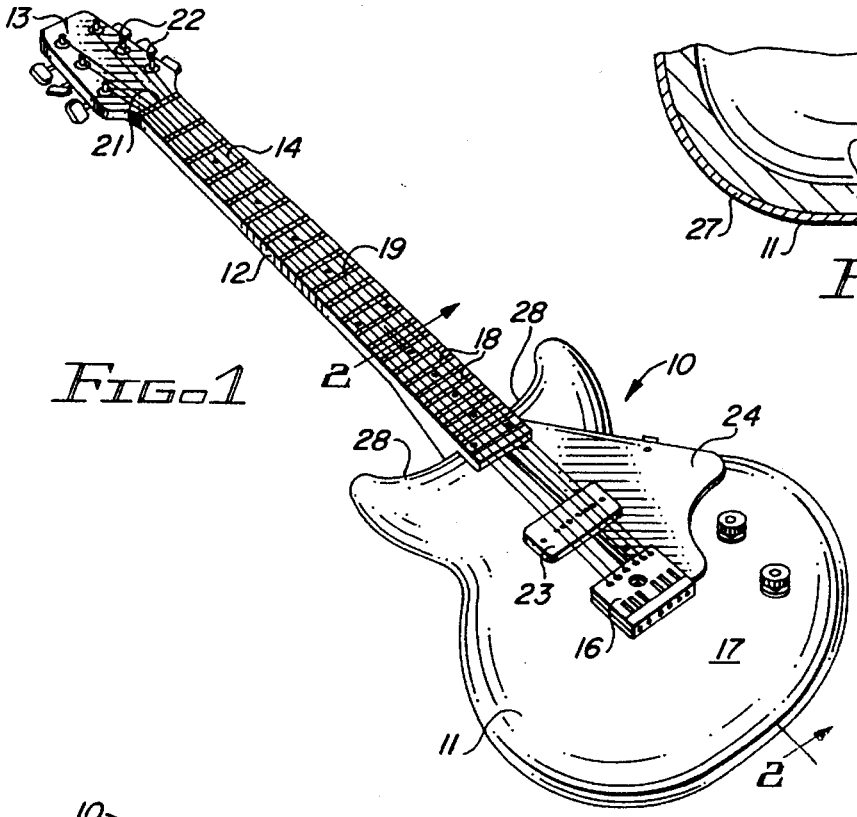
FIG. 1 is a perspective view of an electric guitar constructed in accordance with this invention.

In the drawings, the reference numeral 10 is employed to designate generally a hollowbody version guitar embodying the invention. The basic components are much the same as are found in most electric guitars. This guitar 10 has a body 11, a neck, or neck assembly, 12 and a head 13 at the outer, or distal, end of the neck.

The strings 14 of the guitar are stretched from a combination end piece/bridge 16 on the top surface, or face, 17 of the body 11, over frets 18 on a finger board 19, over a nut 21 to the tuning machines 22. Vibrational motion of the strings 14 is picked up and converted to corresponding electrical signals by a pickup 23 in the top face 17 of the guitar body beneath the strings.

The guitar body 11 may also carry a pick guard 24 on its top face.

The guitar 10 of this invention is distinguished in part from the prior art by utilizing a body 11 which is seamless, metallic, hollow, and substantially free of internal bracing. The body 11 also possesses a substantially thin wall thickness of approximately 1/32 inch (7.9 mm).

The body 11 is preferably electroformed over a destructible mold. In this process, a metal, such as copper, is electrolytically deposited upon a conducting mold shaped to the configuration desired for the body. One such mold can be made of graphite-coated wax, which can be removed from the finished body by melting. Other materials suitable for forming destructible molds are molded bismuth and molded ceramics, both of which are quite frangible and therefore fairly easy to remove from the finished body.

Figure 4:
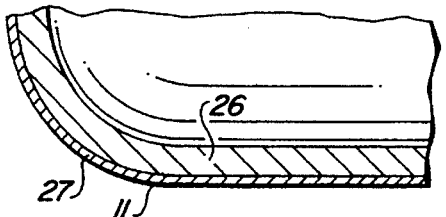
FIG. 4 is an enlarged, fragmentary view of the wall of the guitar body taken as indicated by circle 4 in FIG. 2.

The wall of copper 26 (see FIG. 4) of the electroformed body 11 is polished and electroplated with a thin layer of finish material 27, such as nickel. This finish gives the body 11 of the instrument a strikingly bright, aesthetically pleasing appearance, and, like the finish customarily applied to wood instruments, is believed to enhance the tonal characteristics of the instrument as well.

It should be appreciated that the electroforming technique employed to produce the guitar body 11 lends itself well to the production of bodies in an almost infinite variety of shapes and sizes. For example, simply contouring the formed mold produces the body cutaways 28 near the top of the neck 12 of the guitar illustrated in the drawings.

The electroformed body 11, notwithstanding its light weight, is very rugged and resistant to denting, splitting and scratching. These characteristics are appreciated by traveling musicians.

A further benefit from the employment of the seamless metal body 11 for the guitar is the shielding of electronic components within the body from outside electromagnetic interference. Such components may include one or more potentiometers, indicated at 25, as well as switches and wiring (not shown).

Figure 2:
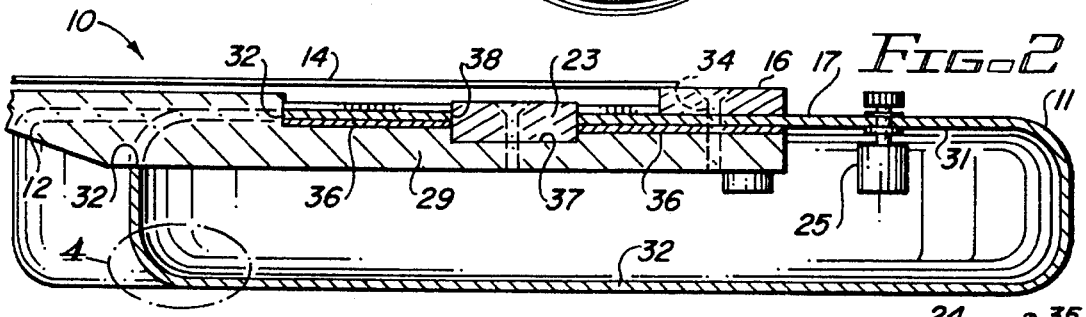
FIG. 2 is a sectional view through the body of the guitar taken generally as indicated by line 2—2 in FIG. 1.
Figure 3:
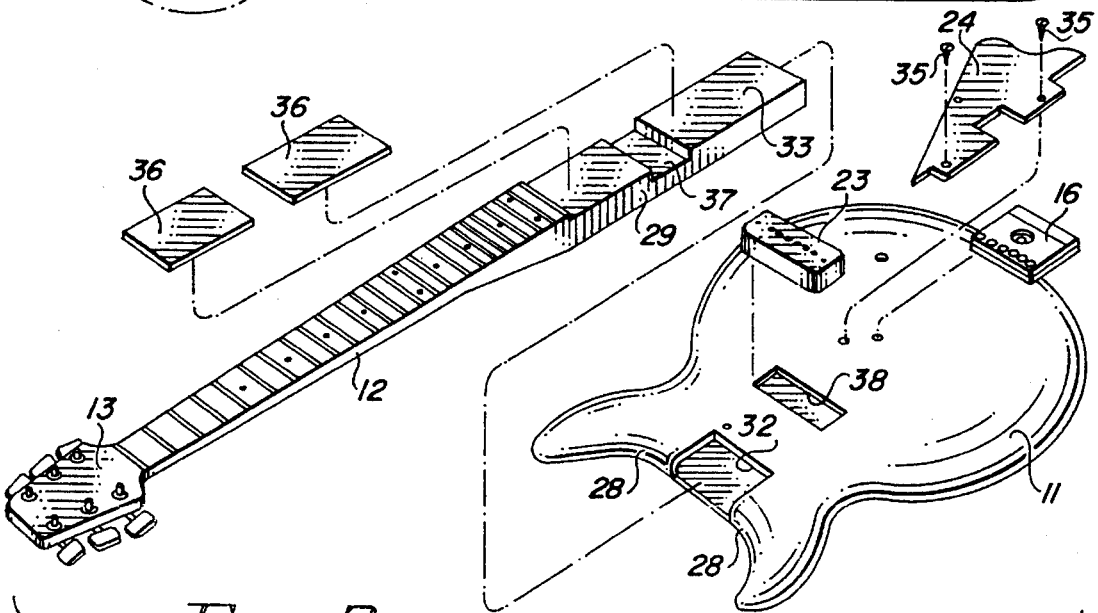
FIG. 3 is an exploded view indicating the assembly of the guitar.

Another important feature of the hollowbody version of this invention is the relationship between the neck assembly 12 and the hollowbody 11. As best shown in FIGS. 2 and 3, the neck assembly 12 includes a base portion 29 adapted to be positioned within the interior of the body and in contact with the inner surface 31 of the top face 17 of the body. An opening 32 is cut into the front portion of the body 11 to permit the base portion 29 of the neck assembly to be inserted into the body 11. This same opening can also provide access to the forming mold for removal of the same. Opening 32 is preferably sized and shaped to closely and frictionally engage the base portion 29 of the neck assembly.

Base portion 29 of neck assembly 12 is positioned in close contact with only the inner surface 31 of the top face of the body 11. In other words, the neck base portion 29 preferably does not contact the bottom wall 32 of the body 11. Thus, the major area of the walls of the body 11 are unencumbered and free to resonate with string vibrations transmitted to the body by the neck assembly 12.

To promote resonance of the body 11, it is preferable to insure that there is a solid, tight contact between the upper surface 33 of the neck assembly and the inner surface 31 of the top face 17 of the body. This can be accomplished in a variety of ways. First is the tight fit of the neck base portion 29 in the opening 32 of the body. Secondly, it is preferable to mount the combination end piece/bridge 16 by means of a fastener, such as a screw 34, which passes through the end piece, through the top face 17 of the body, and into the neck base portion 29 (see FIG. 2). This fastener draws the neck base portion 29 up tight against the inner surface 31 of the body.

Other possible arrangements for securing the neck base portion 29 to surface 31 may involve metalizing the top surface of base portion 29 with metal plates 36 or electrodeposited metal surface areas. These plates or surface areas can be bound to surface 31 either by gluing or by sweat-soldering.

If the guitar is equipped with a pick guard 24, it is preferred that at least a portion of the mounting screws 35 for the guard be screwed into the neck base portion 29 (see FIG. 3).

It will be noted that one upper region of the neck base portion 29 is provided with a recess 37 to receive the pickup 23 so that the latter protrudes through an opening 38 in the top face 17 of the body.

The total area of contact between the upper surface of the neck base portion 29 and the inner surface 31 of the top face 17 of the body preferably is between about 10% and about 25% of the surface of the area of the top face 17. This leaves a substantial area of the top face 17 and the remainder of the body 11 to resonate as mentioned above, more like an acoustic guitar than most electric guitars. This performance is enhanced by the fact that there is substantially no internal bracing for the seamless body 11.

It is important that the neck base portion 29 extends sufficiently far into the body 11 to support and be secured to the bridge/end piece 16 or both of these if they are separate. In this manner, the entire string length is carried by and tension transferred to the neck assembly. This is the structure of an electric guitar which promotes sustain and stability for the notes produced.

Neck assembly 12 can be made from a variety of materials with hardwood being preferred. If desired, a truss rod may be incorporated to reinforce the wood neck assembly. Other materials which may be substituted include cast, machined, or electroformed metal and glass fiber reinforced plastic.

Figure 5:
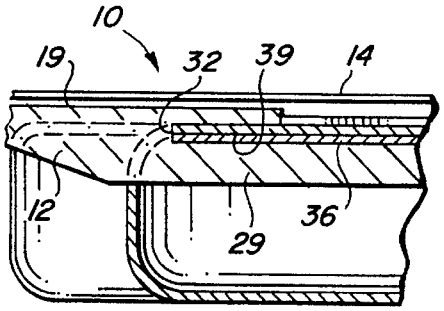
FIG. 5 is a fragmentary sectional view similar to FIG. 2, but showing a modified connection between the body of the guitar and its neck assembly.

FIG. 5 illustrates an alternative connection between the body 11 and the neck assembly 12 in the vicinity of the finger board 19. In this connection the extent to which opening 32 extends across the top face 17 of the body 11 is reduced and a slot 39 is provided in the base portion 29 of the neck assembly 12 beneath the inner end region of the finger board 19. This connection increases the structural integrity of the connection between the neck assembly 12 and the body 11 and also enhances the transmission of sound from the neck to the body.

The hollowbody guitar of this invention is capable of exhibiting a combination of tonal performance characteristics formerly found only in several different types and body styles of guitars. Musicians who have used the instrument have described its performance as being "alive".

Figure 6:
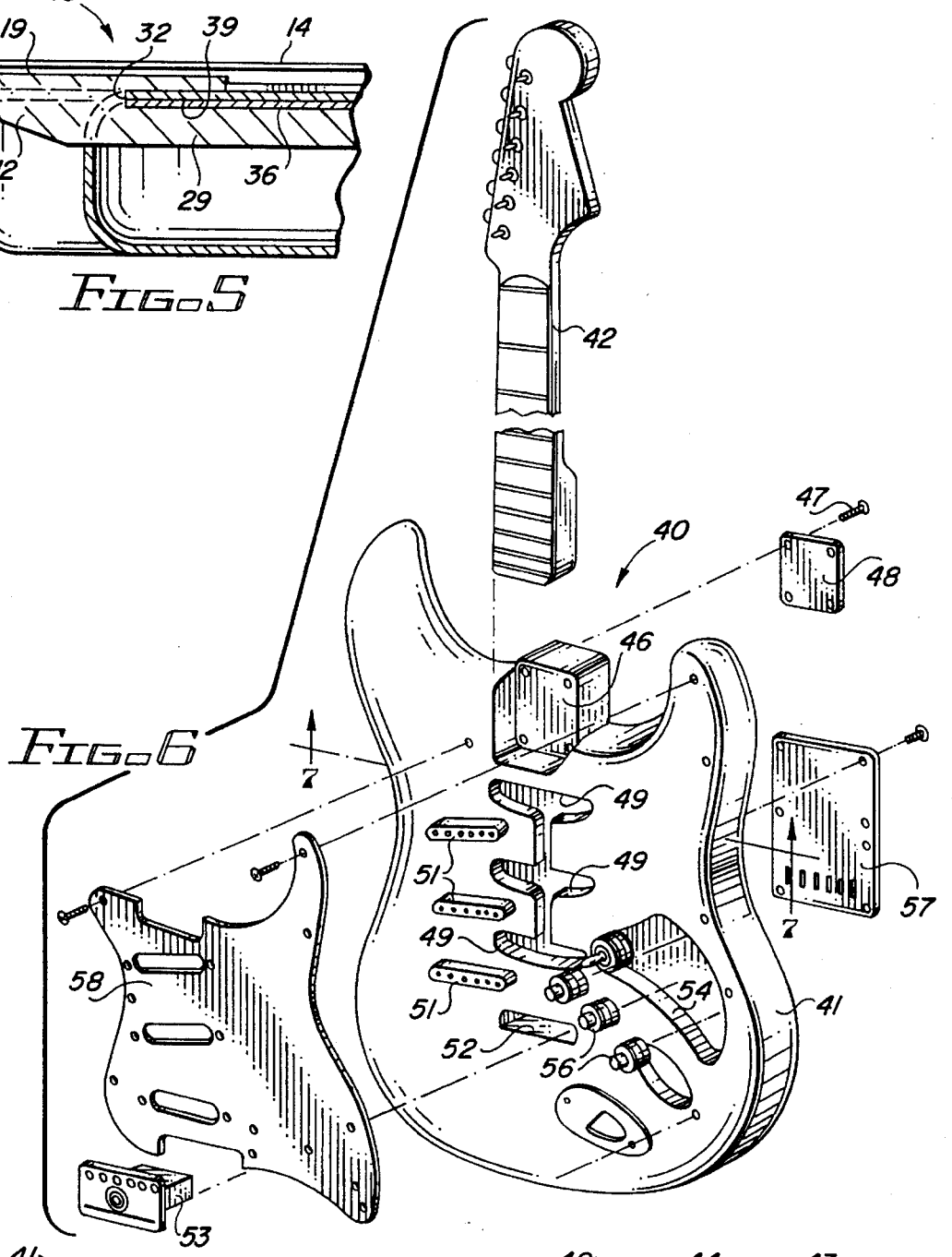
FIG. 6 is an exploded perspective view of a solidbody guitar embodying the invention.
Figure 7:
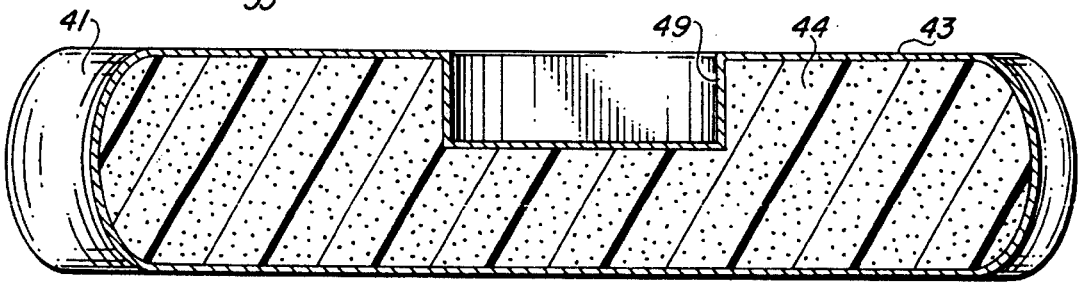
FIG. 7 is a sectional view through the body of the solidbody guitar taken as indicated by line 7—7 in FIG. 6.

As mentioned previously, some musicians prefer the brightness and the sustain characteristics of the solidbody guitar. This invention lends itself well to incorporation in solidbody instruments such as that illustrated in FIGS. 6 and 7.

The numeral 40 designates generally a solidbody guitar embodying the invention. The instrument comprises a body 41 and a neck assembly 42. The body 41 comprises a thin metallic cover 43 electroformed over a mold 44 shaped to the configuration desired for the body 41.

Mold 44 is preferably made from rigid, closed cell polyurethane foam having a density of from approximately 12 pounds to approximately 20 pounds. The foam ingredients when mixed in a shaped mold expand to fill all of the regions of the mold to form all of the desired compartments and mounting configurations for the guitar body 11. Thus, when the metallic cover 43 is electrodeposited over the shaped mold 44 there is provided a mounting ledge 46 to which the neck 42 can be secured to the body 41 by means of screws 47 and a neck plate 48.

Further, the electroplated body 41 may have formed therein recesses 49 to receive pickups 51 and a recess 52 to receive an endpiece/bridge 53. A cavity 54 may also be provided to house controls 56. Cavity 54 may be open to the back face (not shown) of the body 41 to facilitate wiring the controls. If that configuration is used, a cover plate 57 may be fastened over the opening. A pick guard 58 may also be fastened to the front face of the body 41.

With the mold 44 remaining in the body 41 of this solidbody version of the guitar a thinner electroformed cover 43 can be utilized thereby reducing the weight of the instrument.

What is claimed is:

1. A stringed musical instrument comprising:

(a) a seamless metallic hollow body being substantially free of internal bracing, said body having a top face with an inner surface, (b) a neck assembly comprising a base portion and a finger board portion having a head at its distal end, (c) said body having an opening therein for receiving the base portion of said neck assembly, and (d) means for securing the base portion of said neck assembly in contact with the inner surface of the top face of said body.

2. The instrument of claim 1 further comprising a bridge, said bridge being secured to the top face of the body above the base portion of said neck assembly.

3. The instrument of claim 2 further comprising a fastener extending from said bridge through the top face of the body to said base portion of said neck assembly.

4. The instrument of claim 1 further characterized in that the body is electroformed.

5. The instrument of claim 4 further characterized in that the electroformed body is made of copper.

6. The instrument of claim 5 further characterized in that said body is electroplated with a finish of another metal.

7. The instrument of claim 1 further characterized in that the area of contact between the base portion of the neck assembly and the top face of the body is from about 10% to about 25% of the surface area of the top face of the body.

8. The instrument of claim 1 further comprising a pick guard on the top face of the body and fastener means for said pick guard extending through the top face of the body into the base portion of the neck assembly.

9. The method of fabricating a stringed musical instrument comprising the steps of:

(a) providing a destructible electrically conductive mold having a general size and configuration of a desired body for the instrument, (b) electroforming a thin wall, seamless metallic body over said mold, (c) providing at least one opening in said body, (d) destroying the mold and removing it from inside the body to leave a hollow body having a top face and a bottom face, (e) providing a neck assembly having a base portion, (f) inserting the base portion of the neck assembly into the body through an opening in the body, (g) securing the base portion of the neck assembly in close contact with the inner surface of the top face of the body, and (h) stringing the instrument.

10. The method of claim 9 further comprising the step of electroplating the exterior of the electroformed body with a metal different from the metal from which the body is electroformed.

11. A stringed musical instrument comprising:

(a) an electroformed, thin wall, seamless metallic body, (b) a neck assembly comprising a base portion and a finger board portion having a head at its distal end, and (c) means for securing the base portion of said neck assembly to said body.

12. The instrument of claim 11 further comprising a mold disposed in said body, said body being electroformed on said mold.

13. The instrument of claim 12 wherein said mold is formed of foamed plastic material.

* * * * *